United States Patent [19]

Shurnick et al.

[11] Patent Number: 4,852,781

[45] Date of Patent: Aug. 1, 1989

[54] RUNNER'S PORTABLE FLUID SUPPLY CONTAINER

[76] Inventors: Carl W. Shurnick; Sabrina M. Bradley, both of 10062 San Pablo, Fountain Valley, Calif. 92708

[21] Appl. No.: 121,917

[22] Filed: Nov. 17, 1987

[51] Int. Cl.[4] ..... A45F 3/18

[52] U.S. Cl. ..... 224/148; 215/229; 224/267

[58] Field of Search ..... 224/148, 191, 224, 226, 224/182, 257, 267, 269; 220/90.2, 90.4; 215/33, 227, 229, 355

[56] References Cited

U.S. PATENT DOCUMENTS

| | | | |
|---|---|---|---|
| 581,767 | 5/1897 | Powers | 224/148 |
| 3,173,566 | 3/1965 | Talbert | 215/229 |
| 4,090,650 | 5/1978 | Gotta | 224/148 |
| 4,432,477 | 2/1985 | Haidt et al. | 224/267 |
| 4,544,087 | 10/1985 | Modig | 224/148 |
| 4,739,905 | 4/1988 | Nelson | 224/148 |

*Primary Examiner*—Renee S. Luebke

[57] ABSTRACT

A runner's portable water supply is presented. The supply comprises a water bottle with a special cap and sipping tube. The sipping tube is curved and only slightly flexible so that it can be bent, but retains its shape if the wearer does not bend it. The cap fits into the bottle neck in a liquid tight coupling and has a first interior surface slideably mating with the tube in a substantially liquid tight coupling and has a second interior tunnel permitting gas to enter the bottle but deflecting liquid so that liquid cannot splash out of the bottle. The bottle is coupled to a selected part of the wearer's body with the upper end of the tube near the wearer's mouth and the lower end of the tube near the bottom interior surface of the bottle. Air flows into the bottle as liquid is sipped out. The bottle need not be held.

3 Claims, 1 Drawing Sheet

RUNNER'S PORTABLE FLUID SUPPLY CONTAINER

BACKGROUND OF THE INVENTION

1. Field of the Invention

The present invention relates to runner's water bottles which can be used without use of the hands, thereby not interrupting or minimally interrupting the swinging of the runner's arms.

2. Description of the Prior Art

Hot summer weather can kill even the most experienced of runners. Heat does not kill suddenly, or even accidentally like an automobile may, but slowly, quietly, sneakily, and with the full, unthinking cooperation of the victim. Heat has killed at the Boston marathon and annually kills on the football practice field and in a variety of running environments.

Sweat in high temperatures can cause the runner to quickly run out of fluids, thereby reducing sweat, thereby reducing the body's ability to cool itself during exercise. Inability to cool can cause the body temperature to increase to 106 to 108 degrees F. before the runner realizes he is in danger, since a certain amount of ignoring the body's desire to stop is a necessary part of certain types of running.

For example, on a typical summer day of 85 degrees and 50% humidity, a 150 pound runner loses about 6 ounces of body fluid each mile, 80% via sweat and substantially all the balance via breath vapor.

Experimental results (such as those of Costill published in "New Guide to Distance Running" page 238 et seq. 1983) indicate at least a 2 degree lower rectal temperature with fluid replacement and also indicate dangerously high temperatures in marathon class runners of the order of in excess of 105 degrees F. when running without sufficient fluids, above the body temperature of 104.5 degrees F. which is sufficient to cause extreme distress. Costill estimates a runner will lose about 3.7 pounds of water per hour, and can replenish about 1.8 pounds per hour from his stomach, thereby reducing the net loss.

During long runs or marathons, for this reason, one frequently sees runners grabbing drinks on the run. Unfortunately, when one practices, there is unlikely to be anyone present to hand one a drink. For this reason, it would be helpful if the runner could carry extra fluids.

During running, a rhythm is developed. The runner helps his legs by swinging his arms. It would be most helpful is the runner could carry his fluid and take his drink with minimal or even no interference with normal arm swing. In addition, such a fluid container must be convenient to carry and use and also must be as light as possible. It should be possible to carry the container at a point on the runner's body where balance will not be noticeably affected. It should also be inexpensive. Insofar as applicant has been able to determine, the prior art does not disclose such an ideal water bottle for runners.

SUMMARY OF THE INVENTION

A runner's portable fluid supply container is presented. The container comprises a water bottle having a neck having an interior surface capable of removeably coupling to a hollow cap.

The hollow cap has an exterior surface capable of removeably coupling to the interior surface of the neck of the bottle, a first generally cylindrical interior surface capable of coupling around the exterior surface of an only slightly flexible sipping hose disposed through the cap, and a second interior surface defining an air passage only tunnel coupling the exterior atmosphere to the interior of the bottle in a substantially liquid leak proof coupling which permits substantially free flow of gases between the exterior atmosphere and the interior of the bottle adjacent the cap.

Coupling means couple the bottle to a selected part of the wearer's body. A curved hollow sipping tube open at both ends, having a lower interior end adjacent the interior bottom surface of the bottle, and an upper exterior end near the mouth of the wearer of the bottle, the hose curves near the shoulder of the wearer.

In a preferred example, the air passage only tunnel interior surface is generally upside down L-shaped, the top surface of the L exiting into the exterior atmosphere and the bottom surface of the L exiting from the bottom surface of the cap near the top of the bottle, the the top surface of the L defines a liquid deflecting notch in location substantially parallel to the lower surface edge closest to the tunnel exit into the exterior atmosphere and at approximately a 45 degree angle to both top and bottom surfaces of the L.

In operation, the wearer fills the bottle with the desired fluid, then couples the bottle to the desired part of the wearer's body. The tube bottom interior end is adjacent the bottom surface of the interior of the bottle so substantially all the fluid can be sucked out of the bottle. The tube extends through the cap to a point near the mouth of the wearer. The curved, not too flexible design of the tube permits the wearer to rotate his head to grasp the tube end in his mouth and begin sipping. At the end of the sip, the tube is released and returns to the waiting position near the mouth of the wearer. If this is inconvenient, the wearer can move the tube to his mouth with his hand, then release the tube while drinking.

A strap or other coupling means may be used to couple the tube to the shoulder or upper arm of the runner. A clip may be used to couple the tube to the upper arm, defined herein as shoulder, if the runner is wearing a shirt.

The opening at the bottom of the tunnel may be substantially parallel to the opening at the top of the tunnel to reduce liquid entry into the tunnel.

DRAWING DESCRIPTION

Reference should be made at this time to the following detailed description which should be read in conjunction with the following drawings, of which:

DETAILED DESCRIPTION

Figure 1:
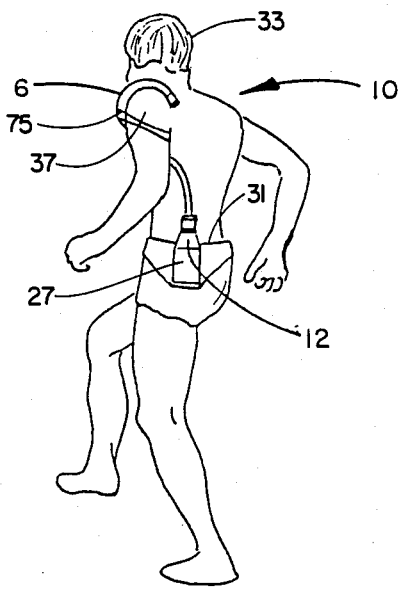
FIG. 1 illustrates a runner carrying a portable fluid supply container according to the present invention.

Reference should be made at this time to FIGS. 1-4 which illustrate various views of the invention.

A runner's portable fluid supply container 10 is presented. The container 10 comprises a water bottle 12 which may of course be utilized for a variety of selected liquids. The bottle 12 has a neck 11 having an interior surface 13 capable of removeably coupling to a hollow cap 14.

The hollow cap 14 has an exterior surface 15 capable of removeably coupling to the interior surface 13 of the neck 11 of the bottle 12. The cap 14 has a first generally cylindrical interior surface 17 capable of coupling around the exterior surface 19 of an only slightly flexible sipping hose 16 disposed through the cap 14. The cap additionally has a second interior surface 21 defining an air passage only tunnel 22 coupling the exterior atmosphere 71 to the interior of the bottle in a substantially liquid leak proof coupling which permits substantially free flow of gases between the exterior atmosphere 71 and the interior 23 of the bottle 12 adjacent the cap 14.

Coupling means 27 couple the bottle 12 to a selected part of the wearers body 31. A curved hollow sipping tube 16 open at both ends, 18,20, has a lower interior end 18 adjacent the interior bottom surface 41 of the bottle 12, and an upper exterior end 20 near the mouth (not shown) of the wearer 31 of the bottle 12. The hose 16, also referred to as a tube 16, curves near the shoulder 37 of the wearer 31.

Figure 4:
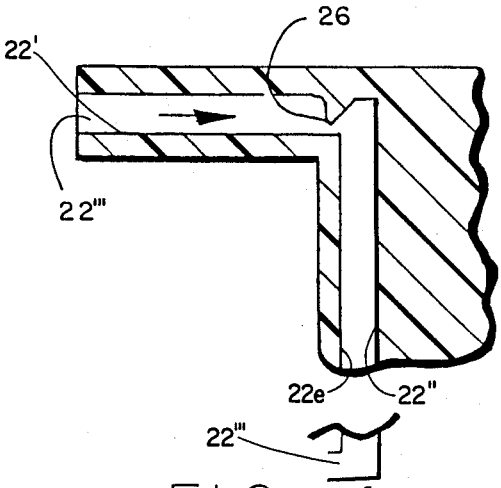
FIG. 4 illustrates the intersection of the two parts of the L shaped gas tunnel through the cap of FIG. 3.
Figure 3:
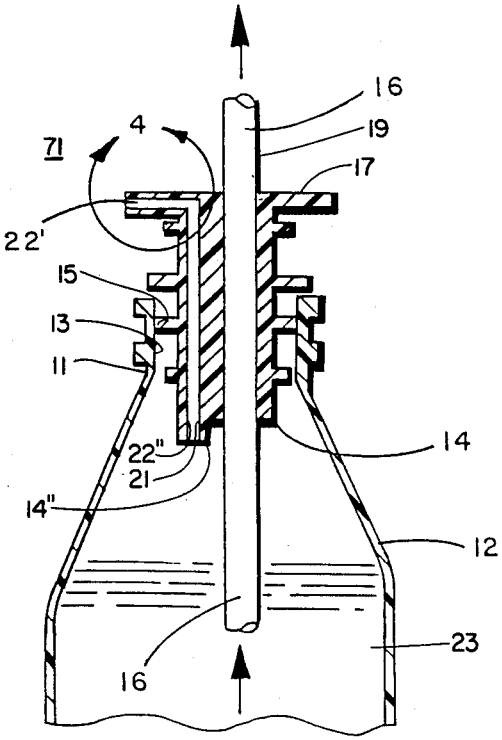
FIG. 3 illustrates in greater detail a partially cut away side view of the neck and cap area of the container of FIG. 2.

In a preferred example, the air passage only tunnel 22 interior surface 21 is generally upside down L-shaped. The top surface 22' of the L exits into the exterior atmosphere 71 and the bottom surface 22'' of the L exits from the bottom surface 14'' of the cap 14 in the neck 11 of the bottle 12. The top surface 22' of the L defines a liquid deflecting notch 26 in location substantially parallel to the lower surface edge 22e closest to the tunnel exit 22''' into the exterior atmosphere 71 and at approximately a 45 degree angle to both top 22' and bottom 22'' surface of the L. As shown in FIG. 4, the bottom surface 22'' may make a right angle to be parallel to the top surface for an incremental distance so that the bottom exit 22'''' is parallel to the top tunnel exit, thereby reducing the possibility that liquid 24 will splash up the tunnel 22.

In operation, the wearer 31 fills the bottle 12 with the desired fluid 24, then couples the bottle 12 to the desired part of the wearer's body 31 (both wearer and body having the same reference number). The tube bottom interior end surface exit 18 is adjacent the bottom surface 41 of the interior of the bottle 12 so substantially all the fluid 24 can be sucked out of the bottle 12. The tube 16 extends through the cap 22 to a point near the mouth (not shown) of the wearer 31. The curved, not too flexible design of the tube 16 permits the wearer 31 to rotate his head 33 to grasp the tube end 20 in his mouth and begin sipping after moving the tube 16 closer to his mouth. At the end of the sip, the tube 16 is released and returns to the waiting position near the mouth of the wearer 31.

Figure 2:
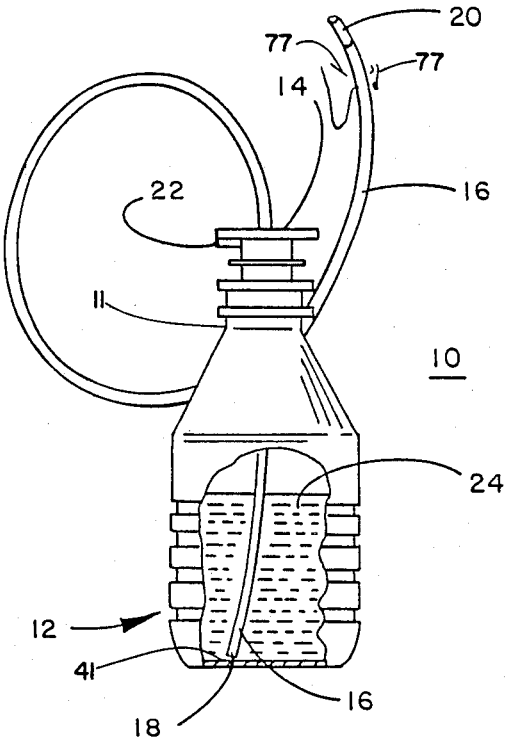
FIG. 2 illustrates a partially cut away side view of the container of FIG. 1.

As shown in FIG. 1, a strap 75 may be utilized to couple the tube 16 directly to the shoulder 37 of the runner 31. Other coupling means may also be utilized. As shown in FIG. 2, a clip may be utilized to couple the tube indirectly to the shoulder 37 of the runner 31 if the runner 31 is wearing a shirt or blouse or the equivalent with a sleeve (not shown).

A particular example of the invention has been described herein to fulfill Code requirements. Other examples will be obvious to those skilled in the art. The invention is limited only by the following claims.

I claim:

1. A runner's portable fluid supply container, comprising:

a water bottle having a neck having an interior surface capable of removeable coupling to a cap;

a hollow cap having an exterior surface capable of removeably coupling to the interior surface of the neck of the bottle, a first generally cylindrical interior surface capable of coupling around the exterior surface of a sipping hose disposed through the cap and a second interior surface defining an air passage only tunnel coupling the exterior atmosphere to the interior of the bottle in a substantially liquid leak proof coupling which permits substantially free flow of gases between the exterior atmosphere and the interior of the bottle adjacent the cap;

coupling means coupling the bottle to a selected part of the wearer's body;

a curved hollow only slightly flexible sipping tube open at both ends, having a lower interior end adjacent the interior bottom surface of the bottle, and an upper exterior end near the mouth of the wearer of the bottle, the hose curving near the shoulder of the wearer;

the air passage only tunnel interior surface is generally upside down L-shaped, the top surface of the L exiting into the exterior atmosphere and the bottom surface of the L exiting from the bottom surface of the cap near the top of the bottle with the opening at the bottom of the tunnel substantially parallel to the opening at the top of the tunnel, the top surface of the L defines a liquid deflecting notch in location substantially parallel to the lower surface edge closest to the tunnel exit into the exterior atmosphere and at approximately a 45 degree angle to both cap top and bottom surfaces of the L; and further including coupling means coupling the tube to the upper arm of the runner.

2. A runner's portable fluid supply container, comprising:

a water bottle having a neck having an interior surface capable of removeable coupling to a cap;

a hollow cap having an exterior surface capable of removeably coupling to the interior surface of the neck of the bottle, a first generally cylindrical interior surface capable of coupling around the exterior surface of a sipping hose disposed through the cap and a second interior surface defining an air passage only tunnel coupling the exterior atmosphere to the interior of the bottle in a substantially liquid leak proof coupling which permits substantially free flow of gases between the exterior atmosphere and the interior of the bottle adjacent the cap;

coupling means coupling the bottle to a selected part of the wearer's body;

a curved hollow only slightly flexible sipping tube open at both ends, having a lower interior end adjacent the interior bottom surface of the bottle, and an upper exterior end near the mouth of the wearer of the bottle, the hose curving near the shoulder of the wearer;

the air passage only tunnel interior surface is generally upside down L-shaped, the top surface of the L exiting into the exterior atmosphere and the bottom surface of the L exiting from the bottom surface of the cap near the top of the bottle with the opening at the bottom of the tunnel substantially parallel to the opening at the top of the tunnel, the top surface of the L defines a liquid deflecting notch in location substantially parallel to the lower surface edge closest to the tunnel exit into the exterior atmosphere and at approximately a 45 degree angle to both top and bottom surfaces of the L; and further including coupling means coupling the tube to the upper arm of the runner.

3. A runner's portable fluid supply container, comprising:

a water bottle having a neck having an interior surface capable of removeable coupling to a cap;

a hollow cap having an exterior surface capable of removeably coupling to the interior surface of the neck of the bottle, a first generally cylindrical interior surface capable of coupling around the exterior surface of a sipping hose disposed through the cap and a second interior surface defining an air passage only tunnel coupling the exterior atmosphere to the interior of the bottle in a substantially liquid leak proof coupling which permits substantially free flow of gases between the exterior atmosphere and the interior of the bottle adjacent the cap;

coupling means coupling the bottle to a selected part of the wearer's body;

a curved hollow only slightly flexible sipping tube open at both ends, having a lower interior end adjacent the interior bottom surface of the bottle, and an upper exterior end near the mouth of the wearer of the bottle, the hose curving near the shoulder of the wearer;

the air passage only tunnel interior surface is generally upside down L-shaped, the top surface of the L exiting into the exterior atmosphere and the bottom surface of the L exiting from the bottom surface of the cap near the top of the bottle with the opening at the bottom of the tunnel substantially parallel to the opening at the top of the tunnel, the top surface of the L defines a liquid deflecting notch in location substantially parallel to the lower surface edge closest to the tunnel exit into the exterior atmosphere and at approximately a 45 degree angle to both top and bottom surfaces of the L; and further including a clip coupling the tube to the upper arm of the runner.

* * * * *